US012435457B2

(12) United States Patent
Fechtel et al.

(10) Patent No.: US 12,435,457 B2
(45) Date of Patent: Oct. 7, 2025

(54) METHOD AND CONTROL UNIT FOR ACTIVATING DETERGENT FOR A CLEANING APPLIANCE WITH A ROTATABLE DRUM WITHOUT RIBS, AND CLEANING APPLIANCE

(71) Applicant: Miele & Cie. KG, Gütersloh (DE)

(72) Inventors: Benedikt Fechtel, Rheda-Wiedenbrück (DE); Rainer Bicker, Verl (DE); Magnus Kortenjann, Telgte (DE); Markus Drücker, Gütersloh (DE); Steffen Lasner, Borgholzhausen (DE); Dirk Sieding, Lünen (DE); Marcel Zielke, Ennigerloh (DE)

(73) Assignee: MIELE & CIE. KG, Gütersloh (DE)

( * ) Notice: Subject to any disclaimer, the term of this patent is extended or adjusted under 35 U.S.C. 154(b) by 355 days.

(21) Appl. No.: 17/915,417

(22) PCT Filed: Mar. 22, 2021

(86) PCT No.: PCT/EP2021/057188
§ 371 (c)(1),
(2) Date: Sep. 28, 2022

(87) PCT Pub. No.: WO2021/197878
PCT Pub. Date: Oct. 7, 2021

(65) Prior Publication Data

US 2023/0134851 A1 May 4, 2023

(30) Foreign Application Priority Data

Mar. 30, 2020 (DE) ..... 10 2020 108 667.9

(51) Int. Cl.
*D06F 33/36* (2020.01)
*D06F 34/18* (2020.01)
(Continued)

(52) U.S. Cl.
CPC ..... *D06F 33/36* (2020.02); *D06F 34/18* (2020.02); *D06F 37/04* (2013.01);
(Continued)

(58) Field of Classification Search
CPC ..... D06F 33/36; D06F 34/18; D06F 37/04; D06F 2103/04; D06F 2103/18; D06F 2105/62
See application file for complete search history.

(56) References Cited

U.S. PATENT DOCUMENTS 8,719,986 B2 * 5/2014 Kim ..... D06F 33/32 210/167.01
2006/0048548 A1 3/2006 Park et al.
(Continued)

FOREIGN PATENT DOCUMENTS

DE 102004039662 A1 2/2006
DE 102008021198 A1 11/2009
(Continued)

OTHER PUBLICATIONS

Machine translation of WO 2020/046076 to Im et al. (Year: 2020).*

*Primary Examiner* — Joseph L. Perrin
(74) *Attorney, Agent, or Firm* — Dickinson Wright PLLC

(57) ABSTRACT

A detergent activation method for a cleaning appliance having a rotatable non-ribbed drum for holding the textiles) and includes a step of supplying a feed signal to a feed unit of the cleaning appliance. The feed signal causes the cleaning liquid to be fed into a suds container until a predetermined target fill level in the drum is reached. In the supplying step, a motion signal may be supplied to a drive of the cleaning appliance when the target fill level is reached, wherein the motion signal causes a rocking rhythm of the drum. The rocking rhythm defines successive rotational motions of the drum at increasing rotational speeds without a complete revolution of the drum. In the supplying step, a
(Continued)

stop signal may be supplied to the drive when a final rotational speed of the rocking rhythm has been reached, to cause the rotational motions of the drum to stop.

15 Claims, 4 Drawing Sheets

(51) Int. Cl.

| | |
|---|---|
| ***D06F 37/04*** | (2006.01) |
| *D06F 103/04* | (2020.01) |
| *D06F 103/18* | (2020.01) |
| *D06F 105/62* | (2020.01) |

(52) U.S. Cl.
CPC ..... *D06F 2103/04* (2020.02); *D06F 2103/18* (2020.02); *D06F 2105/62* (2020.02)

(56) References Cited

U.S. PATENT DOCUMENTS

| | | | | |
|---|---|---|---|---|
| 2008/0028801 | A1* | 2/2008 | Czyzewski | D06F 35/006 68/12.02 |
| 2012/0180534 | A1 | 7/2012 | Cho et al. | |
| 2019/0017210 | A1 | 1/2019 | Han et al. | |

FOREIGN PATENT DOCUMENTS

| | | | | |
|---|---|---|---|---|
| EP | 1505194 | A2 * | 2/2005 | D06F 39/086 |
| WO | WO-2017061836 | A1 * | 4/2017 | D06F 17/08 |
| WO | 2020046076 | A1 | 3/2020 | |

* cited by examiner

METHOD AND CONTROL UNIT FOR ACTIVATING DETERGENT FOR A CLEANING APPLIANCE WITH A ROTATABLE DRUM WITHOUT RIBS, AND CLEANING APPLIANCE

RELATED APPLICATIONS

The present disclosure claims priority to and the benefit of PCT Application PCT/EP2021/057188, filed on Mar. 22, 2021, which claims priority to and the benefit of German Application 10 2020 108 667.9, filed on Mar. 30, 2020, the entire contents of which are incorporated herein by reference.

TECHNICAL FIELD

The disclosure relates to a method and to a control unit for detergent activation for a cleaning appliance having a rotatable non-ribbed drum and a cleaning appliance.

BACKGROUND

EP 2 348 151 B1 relates to a method for operating a washing machine having a circulation device.

SUMMARY

The approach presented herein provides an improved method and an improved control unit for detergent activation for a cleaning appliance having a rotatable non-ribbed drum and an improved cleaning appliance.

According to the disclosure, this is achieved by a method and a control unit for activating detergent for a cleaning appliance having a rotatable non-ribbed drum and by a cleaning appliance having the features of the main claims. Advantageous embodiments and developments of the disclosure can be found in the subsequent sub-claims.

The advantages that can be achieved with the disclosure consist, for example, in improving the thorough mixing of a washing suds and simultaneous wetting of textiles with the washing suds.

A detergent activation method for a cleaning appliance having a rotatable non-ribbed drum for holding the textiles is presented. The method comprises a step of supplying a feed signal to an interface of a feed unit of the cleaning appliance, wherein the feed signal causes the cleaning liquid to be fed into a suds container of the cleaning appliance until a predetermined target fill level reaching into the drum is reached. Furthermore, the method comprises a step of supplying a motion signal to an interface of a drive of the cleaning appliance when the target fill level is reached. The motion signal causes the drum to have a rocking rhythm, which defines successive rotational motions of the drum at increasing rotational speeds without a complete revolution of the drum. In a step of supplying a stop signal, the stop signal is supplied to the interface of the drive when a final rotational speed of the rocking rhythm is reached, wherein the stop signal causes the rotational motions of the drum to stop.

The method can be executed, for example, in a commercially available washing machine. The drum can also be referred to as a laundry drum and is designed to clean the textiles in its interior space. The feed unit can, for example, have a pump and additionally or alternatively a valve in order to convey the cleaning liquid, such as a detergent or a washing suds. The suds container can be arranged around the drum, for example. The target fill level can be a predefined value, for example, up to which the cleaning liquid can be filled, for example at the beginning of a cleaning program. The drive can be implemented, for example, as a motor, by means of which the drum can be set in motion. For example, the drum can move clockwise and anti-clockwise, so that a rocking motion can occur.

According to one embodiment, in the step of supplying the motion signal, the motion signal can cause the rocking rhythm with a frequency between 0.1 Hz and 0.3 Hz. Advantageously, this allows the cleaning liquid to be evenly distributed in the drum.

According to one embodiment, in the step of supplying the motion signal, the motion signal can cause successive rotational motions with a rotational speed increase of between 4 rpm and 6 rpm. Advantageously, the textiles can be at least almost completely wetted by the increase in speed.

Furthermore, according to one embodiment, in the step of supplying the stop signal, the final rotational speed can be between 50 rpm and 70 rpm. This means that the stop signal is supplied when the final rotational speed reaches a value between 50 rpm and 70 rpm.

According to one embodiment, the method can comprise a step of reading in an amount signal via an interface of an amount determination device before the cleaning liquid is fed in, wherein the amount signal represents a load amount of the textiles. The amount determination device can be designed as a sensor, for example. The load amount can be determined, for example, using the inertia method or alternatively by weighing the textiles.

Furthermore, the method can comprise a step of determining the target fill level using the amount signal. Advantageously, an amount of the cleaning liquid can be matched to the load amount, so that resources can be saved, for example.

The method may comprise a step of adjusting a frequency of the rocking rhythm using the amount signal. Advantageously, the drum can be caused to execute the rocking rhythm more slowly if, for example, a small load amount is loaded.

According to one embodiment, a first frequency of the rocking rhythm can be adjusted in the step of adjusting if the amount signal represents a first load amount of the textiles, and a second frequency of the rocking rhythm can be adjusted if the amount signal represents a second load amount of the textiles. In this case, the second frequency can be lower than the first frequency if the second load amount is smaller than the first load amount. This means that, for example, with a large load amount, the rocking rhythm is slowed down and, with a small load amount, the rocking rhythm accelerates.

According to one embodiment, the step of supplying the feed signal can be executed again after the step of supplying the stop signal, until the predetermined target fill level is reached again.

The approach presented herein also creates a control unit designed to execute, control, or implement the steps of a variant of a method presented herein in corresponding devices. The problem addressed by the disclosure can also be solved quickly and efficiently by this embodiment variant of the disclosure in the form of an apparatus.

The control unit can be designed to read in input signals and to determine and supply output signals using the input signals. An input signal can represent, for example, a sensor signal that can be read in via an input interface of the control unit. An output signal can represent a control signal or a data signal that can be supplied at an output interface of the control unit. The control unit can be designed to determine the output signals using a processing specification implemented in the hardware or the software. For example, the control unit can for this purpose comprise a logic circuit, an integrated circuit, or a software module and can be implemented as a discrete component or comprised by a discrete component.

A computer program product or computer program with program code which can be stored on a machine-readable carrier or storage medium, such as a semiconductor memory, a hard disk memory, or an optical memory, including non-transitory storage mediums even if such mediums do not necessarily store information permanently, for example random access memory (RAM) is also advantageous. If the program product or program is executed on a computer or a control unit, the program product or program can then be used to execute, implement, and/or control the steps of the method according to one of the embodiments described above.

Furthermore, a cleaning appliance for cleaning textiles is presented, which has a suds container, a rotatable, non-ribbed drum arranged in the suds container for holding the textiles, a feed unit for feeding the cleaning liquid into the drum, a drive for setting the drum in a rotational motion, and a control unit in an aforementioned variant.

The cleaning appliance can be used, for example, as a standard domestic appliance, but also be implemented as a commercial or professional appliance. The drum can also be referred to as a laundry drum. The feed unit can be implemented, for example, as a pump or as a valve. The control unit can be designed, for example, to control or execute a method in one of the aforementioned variants.

According to one embodiment, an inside of a drum casing of the drum can be designed to be smooth, apart from an enlargement with a plurality of entraining elements. The inside of the drum casing and additionally or alternatively the enlargement can have honeycomb structural elements, for example. The entraining elements can be shaped like nubs, for example, so that they are arranged approximately at right angles to the enlargement. A non-ribbed drum is used, for example, when the drum does not contain any geometry projecting from the surface where the drum radius is reduced by more than 10%. Such a non-ribbed drum can thus have no ribs on the inside which extend between the drum base and the drum opening, for example parallel to the axis of rotation of the drum. An entraining element can be understood to mean a hump-like elevation on the inside of the drum. An entraining element can be pyramid-shaped or tapered. An entraining element can have a circle or a regular polygon as its base. An entraining element can also be referred to as a structural element or hump.

According to one embodiment, the enlargement can be directed inwards and project into a holding space of the drum. The enlargement can advantageously form a cavity on a side facing away from the inside of the drum casing, for example to achieve a suction effect when the cleaning agent is mixed with the cleaning liquid, for example.

According to one embodiment, at least one of the entraining elements can have at least one through-opening, which is arranged on a side flank of the entraining element or on an upper edge of the entraining element. The through-opening advantageously has a diameter in a range between 1.4 mm and 3.7 mm.

BRIEF DESCRIPTION OF THE DRAWINGS

An embodiment of the disclosure is shown in the drawings in a purely schematic manner and will be described in more detail below. In the drawings.

DETAILED DESCRIPTION OF THE DRAWINGS

Figure 1:
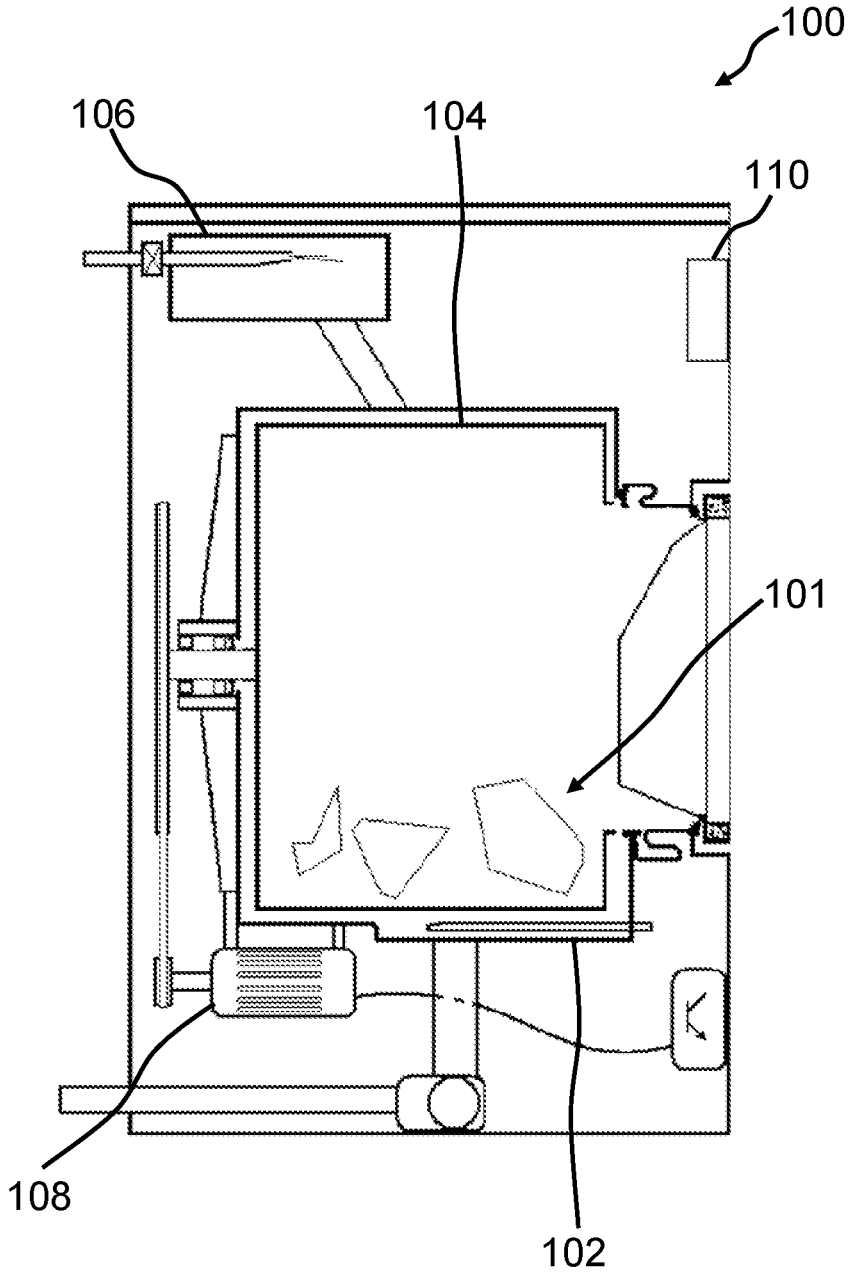
FIG. 1 is a schematic representation of a cleaning appliance according to one embodiment.

FIG. 1 is a schematic representation of a cleaning appliance 100 according to one embodiment. The cleaning appliance 100 can be implemented as a commercially available washing machine, which can be used, for example, for private purposes, but also for commercial purposes. The cleaning appliance 100 is designed to clean textiles 101. For this purpose, the cleaning appliance 100 has a suds container 102, a rotatable non-ribbed drum 104 arranged in the suds container 102, a feed unit 106, a drive 108, and a control unit 110. The suds container 102 is designed to collect a cleaning liquid. The drum 104 is designed to accommodate the textiles 101, for example for a cleaning process. The feed unit 106 is designed to feed the cleaning liquid to the drum 104. The drive 108 is designed to cause the drum 104 to execute a rotational motion. The control unit 110 is designed to actuate the feed unit 106 and the drive 108 according to this embodiment and to execute a detergent activation method, for example, as is described in more detail in one of the following drawings. Apart from an enlargement with a plurality of entraining elements, an inside of a drum casing of the drum 104 is smooth according to this embodiment, as is described in more detail in one of the following drawings. The drum 104 is non-ribbed.

Figure 2:
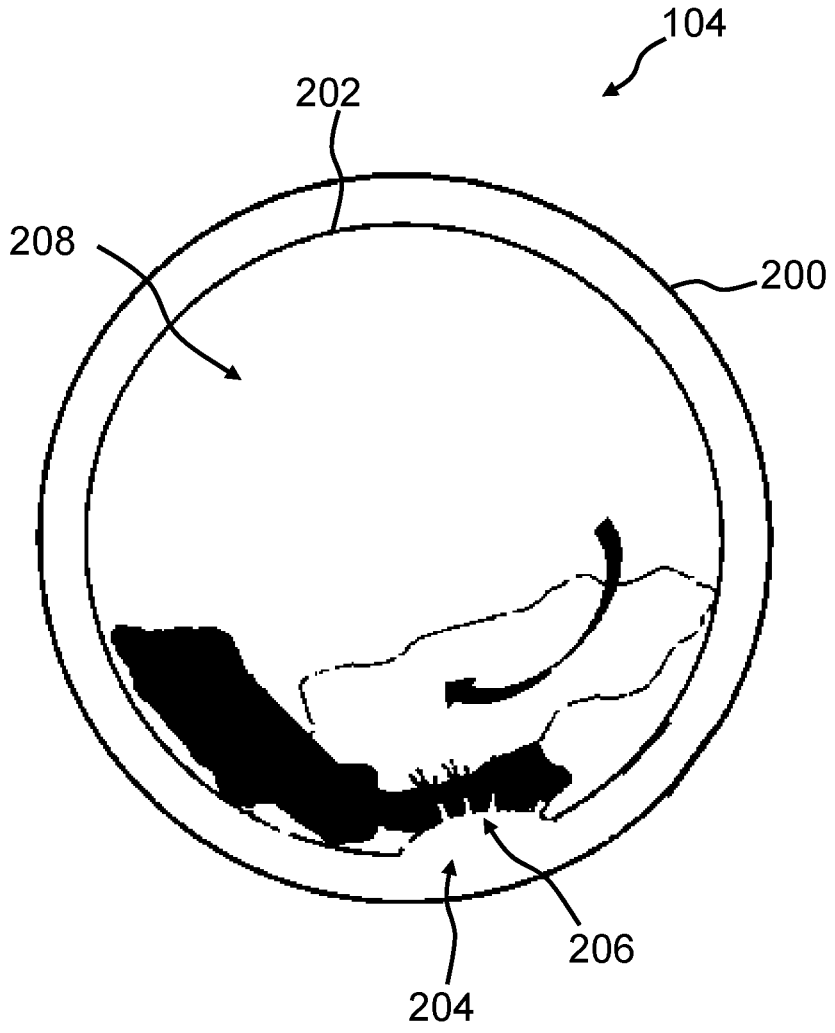
FIG. 2 is a schematic representation of a drum according to one embodiment of a cleaning appliance.

FIG. 2 is a schematic view of a drum 104 according to one embodiment of a cleaning appliance. The drum 104 can be arranged in a cleaning appliance, for example, as was described in FIG. 1. The drum casing 200 of the drum 104 has the enlargement 204 on its inside 202, on which the plurality of entraining elements 206 is arranged. According to this embodiment, the enlargement 204 is directed inwards, so that it projects into a holding space 208 of the drum 104. This means that the entraining elements 206 form a cavity on a side of the drum casing 200 facing away from the inside 202 of the drum casing 200. According to this embodiment, at least one of the entraining elements 206 has at least one through-opening, which is arranged on a side flank of the entraining element or on an upper edge of the entraining element. According to this embodiment, the through-opening has a diameter of, for example, 1.5 mm to 3.6 mm.

Figure 3:
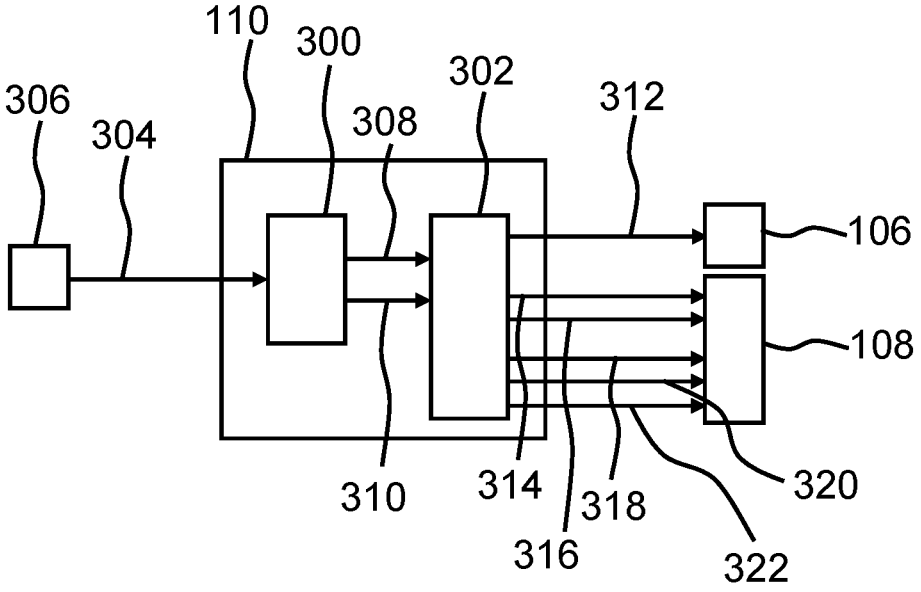
FIG. 3 is a block diagram of a control unit according to one embodiment of a cleaning appliance.

FIG. 3 is a block diagram of a control unit 110 according to one embodiment of a cleaning appliance. The control unit 110 can be used, for example, in a cleaning appliance as described in FIG. 1 in order to move a non-ribbed drum as described in FIG. 2. In this case, the control unit 110 is designed to control a detergent activation method. For this purpose, according to this embodiment, the control unit 110 has a read-in unit 300 and a supply unit 302. In this case, the read-in unit 300 is designed to read in an amount signal 304 via an interface of an amount determination device 306. The amount signal 304 represents a load amount of the textiles. According to this embodiment, the control unit 110 determines a target fill level 308 using the amount signal 304 and is designed to set a frequency 310 of a rocking rhythm of the drum, also using the amount signal 304. For example, a first frequency of the rocking rhythm is adjusted when the amount signal 304 represents a first load amount of the textiles, and a second frequency of the rocking rhythm is adjusted, for example, when the amount signal 304 represents a second load amount of the textiles. In this case, the second frequency is lower than the first frequency if the second load amount is smaller than the first load amount.

The supply unit 302 is designed to provide a feed signal 312 to an interface of the feed unit 106 of the cleaning appliance. In this case, the feed signal 312 causes the cleaning liquid to be fed into the suds container of the cleaning appliance until the predetermined target fill level 308 reaching into the drum is reached. Furthermore, the supply unit 302 is designed to supply a motion signal 314 to an interface of a drive 108 of the cleaning appliance when the target fill level 108 has been reached. The motion signal 314 causes the drum to have a rocking rhythm, which defines successive rotational motions of the drum at increasing rotational speeds without a complete revolution of the drum. Furthermore, the supply unit 302 supplies a stop signal 316 to the interface of the drive 108 when a final rotational speed of the rocking rhythm has been reached. The stop signal 316 causes the rotational motions of the drum to stop. The motion signal 314 causes the rocking rhythm according to this embodiment at a frequency 310 between 0.1 Hz and 0.3 Hz. Furthermore, the motion signal 314 causes successive rotational motions at a rotational speed increase of between 4 rpm and 6 rpm. According to this embodiment, the final rotational speed is between 50 rpm and 70 rpm.

According to this embodiment, the rocking rhythm is characterized such that the motion signal 314 only optionally causes a first rotational motion of the drum in a first direction until the drum has reached a first target rotational speed. A second motion signal 318 causes, for example, a second rotational motion of the drum in a second direction, opposite the first direction, until the drum has reached a second target rotational speed greater than the first target rotational speed. A further first motion signal 320 continues to cause a further first rotational motion of the drum in the first direction until the drum has reached a further first target rotational speed greater than the second target rotational speed of the preceding second rotational motion. Analogously to this, a further second motion signal 322 causes a further second rotational motion of the drum in the second direction until the drum has reached a further second target rotational speed greater than the further first target rotational speed of the preceding further first rotational motion. As a result, only optionally the rotational motion, the second rotational motion, the further first rotational motion, and the further second rotational motion cause the rocking rhythm of the drum, which is formed, for example, from a predetermined frequency, the final rotational speed, and a predetermined increase in rotational speed. According to this embodiment, the first motion signal also optionally causes a first acceleration of the drum, the second motion signal can cause a second acceleration of the drum greater than the first acceleration, the further first motion signal can cause a further first acceleration of the drum greater than the second acceleration, and the further second motion signal causes a further second acceleration greater than the further first acceleration.

In other words, the approach presented herein presents an opportunity for detergent activation in a non-ribbed drum, which is also referred to as a washing drum. Detergent activation requires good mixing and agitation of, for example, a liquid, detergent and textiles so that the detergent is completely dissolved in the liquid. For this purpose, a target fill level of the cleaning liquid is adjusted so high that the suds mixture that has not yet been completely dissolved and activated becomes visible in the drum and comes into contact with the textiles and an outer surface of the drum. According to this embodiment, the drum is set in the rocking rhythm so that the mixture of water and detergent, which is referred to as cleaning liquid, is entrained and homogenized on the one hand by frictional forces on a drum base and on the other hand by the moving textiles. In the case of small load amounts, according to this embodiment, the rocking rhythm is slowed down in such a way that the drum casing glides under the textiles, which are also referred to as laundry. The saturated textile and the precisely adjusted liquid level allow a "gliding function" so that the entrained water flows through and around the laundry and mixes to form homogeneous suds. According to this embodiment, the rocking rhythm is characterized in that the drum does not complete a complete revolution and, after reaching the final rotational speed, a pause or a drum standstill is inserted so that the water level returns to a level that allows the process described to be repeated as desired.

According to this embodiment, small holes, which are referred to herein as through-openings, in the region of the entraining honeycomb support the activation of the detergent. According to this embodiment, the enlargement, which is also referred to as an entraining honeycomb, forms a cavity on the rear side of the drum casing, in which air is trapped when immersed in the cleaning liquid. This air escapes in the direction of the textiles through small through-openings with a diameter of, for example, 1.5 mm to 3.6 mm and then, due to its suction effect, draws cleaning liquid with it. This is now pressed into the textiles like a geyser, so that the activation process and the washing effect are supported. The through-openings are preferably attached to a lower and upper side flank and/or to an upper side of the entraining element.

According to an alternative embodiment, an additional use of an existing circulation is possible, which accelerates the activation process by feeding the cleaning liquid.

Figure 4:
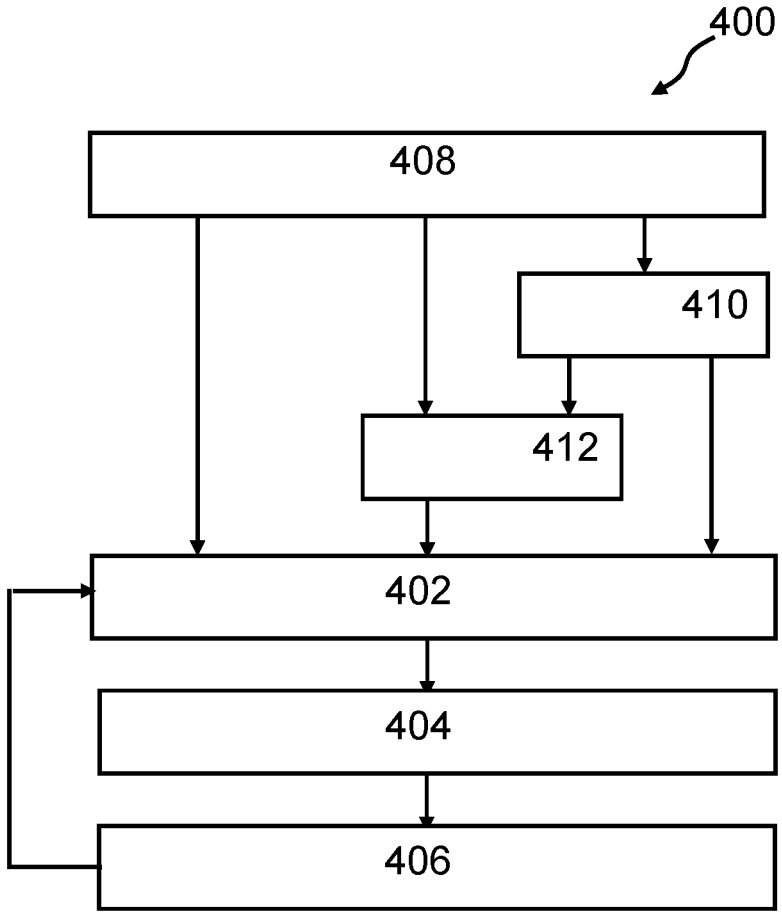
FIG. 4 is a flowchart of a method for detergent activation for a cleaning appliance according to one embodiment.

FIG. 4 is a flowchart of a method 400 for detergent activation for a cleaning appliance according to one embodiment. The method 400 can be executed, for example, by a control unit as was described in FIG. 3. Correspondingly, the method 400 can be executed in a cleaning appliance, as was described in FIG. 1. The method 400 comprises a step 402 of supplying a feed signal to an interface of a feed unit of the cleaning appliance, wherein the feed signal causes the cleaning liquid to be fed into a suds container of the cleaning appliance until a predetermined target fill level reaching into the drum is reached. In a step 404 of supplying, a motion signal is supplied to an interface of a drive of the cleaning appliance when the target fill level is reached, wherein the motion signal causes a rocking rhythm of the drum. The rocking rhythm defines successive rotational motions of the drum at increasing rotational speeds without a complete revolution of the drum. Furthermore, the method 400 comprises a step 406 of supplying a stop signal to the interface of the drive when a final rotational speed of the rocking rhythm is reached. The stop signal causes the rotational motions of the drum to stop.

According to this embodiment, the method 400 comprises a step 408 of reading in an amount signal via an interface of an amount determination device before the cleaning liquid is fed in, wherein the amount signal represents a load amount of the textiles. In a step 410 of determining, according to this embodiment, the target fill level is determined using the amount signal. Furthermore, the method 400 according to this embodiment comprises a step 412 of adjusting a frequency of the rocking rhythm using the amount signal. According to this embodiment, step 402 is executed again after step 406 of supplying the stop signal, until the predetermined target fill level is reached again.

The invention claimed is:

1. A method for detergent activation for a cleaning appliance having a rotatable non-ribbed drum for holding the textiles, the method comprising the following steps:

supplying a feed signal to an interface of a feed unit of the cleaning appliance, wherein the feed signal causes the cleaning liquid to be fed into a suds container of the cleaning appliance until a predetermined target fill level in the drum is reached;

supplying a motion signal to an interface of a drive of the cleaning appliance when the target fill level is reached, wherein the motion signal causes a rocking rhythm of the drum, wherein the rocking rhythm defines successive rotational motions of the drum at increasing rotational speeds without a complete revolution of the drum including a first rotational motion of the drum in a first direction until the drum has reached a first target rotational speed, and a second rotational motion of the drum in a second direction, opposite the first direction, until the drum has reached a second target rotational speed greater than the first target rotational speed; and supplying a stop signal to the interface of the drive when a final rotational speed of the rocking rhythm is reached, wherein the stop signal causes the rotational motions of the drum to stop.

2. The method according to claim 1, wherein the motion signal, in the step of supplying the motion signal, causes the rocking rhythm with a frequency between 0.1 Hz and 0.3 Hz.

3. The method according to claim 1, wherein in the step of supplying the motion signal, the motion signal causes successive rotational motions with a rotational speed increase of between 4 rpm and 6 rpm.

4. The method according to claim 1, wherein, in the step of supplying the stop signal, the final rotational speed is between 50 rpm and 70 rpm.

5. The method according to claim 1, comprising a step of reading in an amount signal via an interface of an amount determination device before the cleaning liquid is fed in, wherein the amount signal represents a load amount of the textiles.

6. The method according to claim 5, comprising a step of determining the target fill level using the amount signal.

7. The method according to claim 5, comprising a step of adjusting a frequency of the rocking rhythm using the amount signal.

8. The method according to claim 7, wherein, in the adjusting step, a first frequency of the rocking rhythm is adjusted if the amount signal represents a first load amount of the textiles, and a second frequency of the rocking rhythm is adjusted if the amount signal represents a second load amount of the textiles, wherein the second frequency is lower than the first frequency if the second load amount is smaller than the first load amount.

9. The method according to claim 1, wherein the step of supplying the feed signal is executed again after the step of supplying the stop signal until the predetermined target fill level is reached again.

10. A control unit configured to execute the steps of the method according to claim 1 in corresponding units.

11. A non-transitory computer-readable medium having program code for executing the method according to claim 1.

12. A cleaning appliance for cleaning textiles, comprising:

a suds container for collecting a cleaning liquid;

a rotatable non-ribbed drum disposed in the suds container for holding the textiles;

a feed unit for feeding the cleaning liquid into the drum;

a drive for causing the drum to execute a rotational motion; and a control unit configured to, supply a feed signal to an interface of the feed unit, wherein the feed signal causes the cleaning liquid to be fed into the suds container until a predetermined target fill level in the drum is reached;

supply a motion signal to an interface of the drive when the target fill level is reached, wherein the motion signal causes a rocking rhythm of the drum, wherein the rocking rhythm defines successive rotational motions of the drum at increasing rotational speeds without a complete revolution of the drum including a first rotational motion of the drum in a first direction until the drum has reached a first target rotational speed, and a second rotational motion of the drum in a second direction, opposite the first direction, until the drum has reached a second target rotational speed greater than the first target rotational speed, and supply a stop signal to the interface of the drive when a final rotational speed of the rocking rhythm is reached, wherein the stop signal causes the rotational motions of the drum to stop.

13. The cleaning appliance according to claim 12, wherein an inside of a drum casing of the drum is smooth apart from an enlargement having a plurality of entraining elements.

14. The cleaning appliance according to claim 13, wherein the enlargement is directed inwards and projects into a holding space of the drum.

15. The cleaning appliance according claim 13, wherein at least one of the entraining elements has at least one through-opening which is arranged on a side flank of the entraining element or on an upper edge of the entraining element.

* * * * *